US007073367B1

(12) United States Patent
Aldridge

(10) Patent No.: US 7,073,367 B1
(45) Date of Patent: Jul. 11, 2006

(54) EARRING WIRE FORMING APPARATUS

(76) Inventor: Anthony Bruce Aldridge, P.O. Box 1396, Vernon, British Columbia (CA) V1T 6N7

( * ) Notice: Subject to any disclaimer, the term of this patent is extended or adjusted under 35 U.S.C. 154(b) by 0 days.

(21) Appl. No.: 11/205,833

(22) Filed: Aug. 17, 2005

(51) Int. Cl.
*B21F 1/06* (2006.01)
*B21L 13/00* (2006.01)

(52) U.S. Cl. ..... 72/457; 72/306; 72/387; 140/102.5; 140/104

(58) Field of Classification Search ..... 72/306, 72/321, 387, 457; 140/102.5, 104
See application file for complete search history.

(56) References Cited

U.S. PATENT DOCUMENTS 189,264 A * 4/1877 Reynolds ..... 140/104
1,752,726 A * 4/1930 Brannaka ..... 140/104
2,006,355 A * 7/1935 Howell ..... 140/104
2,212,415 A * 8/1940 Butler ..... 72/457
2,485,459 A * 10/1949 Rackowski ..... 140/102.5
3,847,189 A * 11/1974 Guzda ..... 140/102.5
4,421,145 A * 12/1983 Broberg, Jr. ..... 140/104
4,423,757 A * 1/1984 Broberg, Jr. ..... 140/104
4,566,305 A * 1/1986 Wool ..... 72/387
5,632,086 A * 5/1997 Helwig ..... 72/457
5,809,824 A * 9/1998 Hiltzman ..... 72/387

* cited by examiner

*Primary Examiner*—David Jones
(74) *Attorney, Agent, or Firm*—Holland & Knight LLP

(57) ABSTRACT

An earring wire forming apparatus including a base, a lever rotatably mounted on the base and a wire retaining member rotatably mounted on the base for holding a piece of wire of predetermined length therein and limiting the rotational movement of the lever between a first position and a second position. The lever defines a first cylindrical projection thereon having a generally crescent-shaped slot in an upper portion thereof and a second cylindrical projection of a smaller diameter spaced from the first projection. A disk-shaped forming member is removably and rotatably mounted on the second cylindrical projection on the lever and carries a depending pin movable with the forming member between a first position wherein the pin extends into the slot in the cylindrical projection on the lever and a second position adjacent the opposite side of the projection from the slot.

18 Claims, 5 Drawing Sheets

EARRING WIRE FORMING APPARATUS

BACKGROUND OF THE INVENTION

The present invention is directed to an inexpensive hand-operated earring wire forming device for economically producing earring wires in a Shepherd or French Hook design. The popular Shepherd or French Hook earring wire design comprises an upper open large loop portion that extends through the wearer's ear lobe and a depending, smaller, substantially closed loop portion that is positioned at the outer lower end of the upper loop portion for carrying one or more jewels or other objects of design. A vertical leg portion depends from the inner end of the upper loop portion and terminates in an outwardly inclined end portion. Such an earring wire design is commonly used on expensive as well as costume jewelry and is typically formed by a variety of hand operated and automated machines. The automated earring wire formers are utilized for large production. Unfortunately, however, even hand operated wire forming machines also are relatively complex and thus quite costly. As a result, the cost of manufacturing otherwise inexpensive earrings is significantly increased. This increase becomes substantial in low volume production where the cost of the wire forming machine cannot be justified by reduced labor costs. As a result, for very low volume applications, the earring wires are typically formed using round nose pliers which is a slow process and may not produce consistent results. It would be highly desirable for such low volume applications, if an inexpensive hand-operated forming device were available to reduce the cost of earring manufacture. The present invention provides such a device.

SUMMARY OF THE INVENTION

Briefly, the present invention is directed to a hand-operated earring wire forming device having a base portion, a kicker rotatably mounted on the base portion and having a longitudinally extending groove formed therein for carrying a measured length of wire and a forming lever rotatably mounted on the base portion between a first stop defined by a first portion of the kicker and a second stop defined by a second portion of the kicker. The forming lever has a crescent-shaped slot formed in an upstanding cylindrical projection thereon adjacent the axis of rotation of the lever. The forming disk is removeably mounted on a center post on the lever so as to be rotatable thereon between a first position in which a depending pin on the disk extends into the crescent-shaped slot in the lever and a second position in which the pin is adjacent the upstanding cylindrical projection on the lever proximate the backside of the crescent-shaped slot.

Upon positioning the forming lever adjacent the first stop on the kicker and inserting a wire of predetermined length in the groove in the kicker, the wire will extend from the groove between the cylindrical projection and the center post on the lever. Whereupon, positioning the forming disk on the lever in the aforesaid first position such that the disk pin projects into the crescent-shaped slot in the lever, and while holding the wire on the kicker and simultaneously rotating the disk counterclockwise to the second position causes a portion of the wire to be wrapped about the upstanding center post on the lever, forming the small loop portion of the earring wire design. Subsequent rotation of the lever in a clockwise direction until the lever abuts the second stop on the kicker, forms the large loop portion of the earring wire. Further clockwise rotation of the lever causes the kicker to move creating the aforesaid outwardly inclined end portion of the earring wire.

It is therefore the principal object of the present invention to provide an earring wire forming device which is of simple construction, economical to manufacture and easily operated to produce earring wires of consistent quality in a Shepherd or French Hook design.

This and other objects and advantages of the present invention will become readily apparent from the following detailed description taken in conjunction with the accompanying drawings.

DETAILED DESCRIPTION OF THE PREFERRED EMBODIMENT

Figure 1:
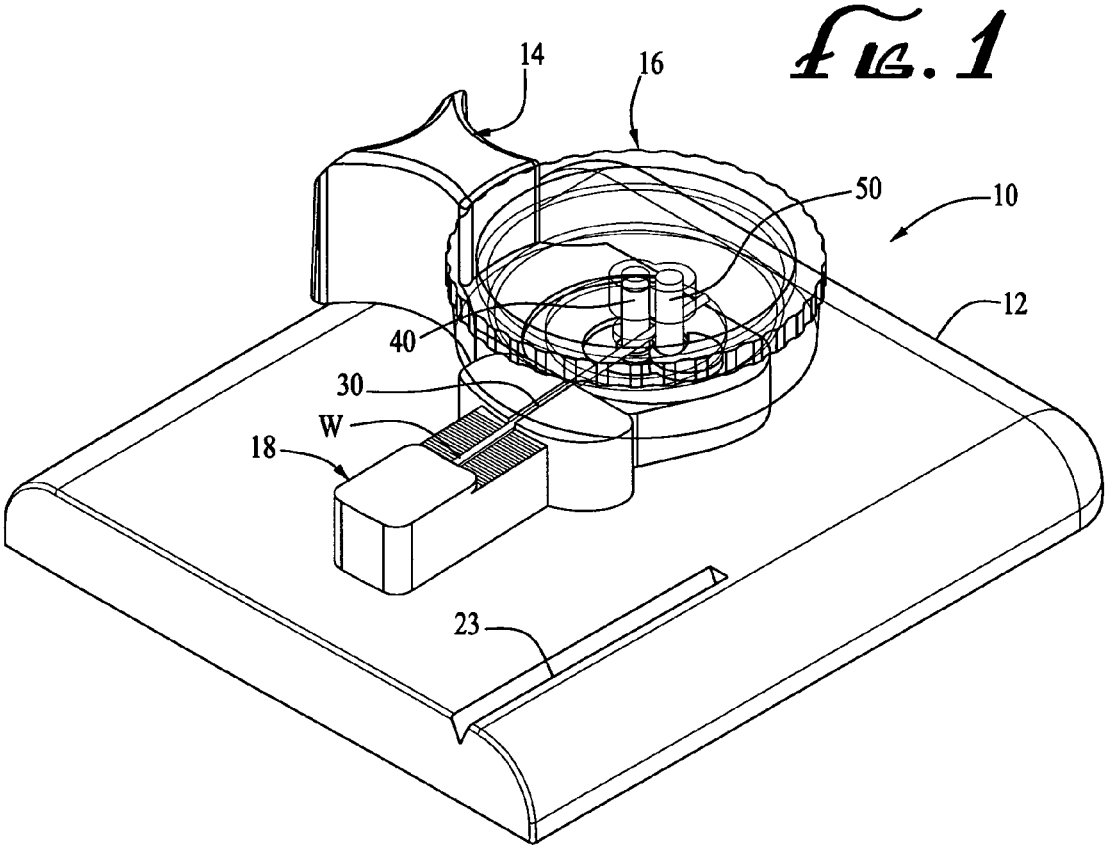
FIG. 1 is a perspective view of the earring wire forming device of the present invention.
Figure 3:
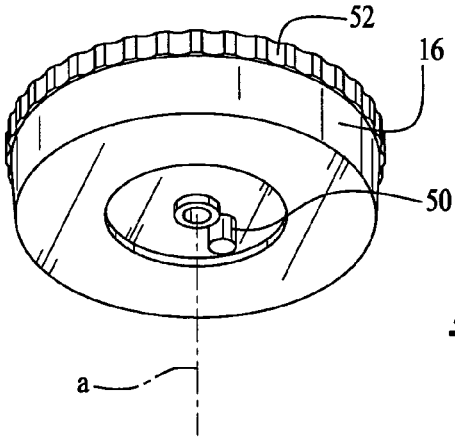
FIG. 3 is a perspective view of the forming disk employed in the forming device of the present invention.

Referring now in detail to the drawings, the earring forming device 10 of the present invention comprises a base 12, lever 14, forming member or disk 16 and wire holding member hereinafter referred to as a kicker 18. With the exception of the forming disk 16, each of said components is preferably formed of a suitable plastic material such as ABS. Other suitable materials, however, could be employed. For reasons that will become apparent, the forming disk is preferably formed of a transparent plastic material such as polycarbonate to facilitate positioning the wire.

The base 12 of forming device 10 defines an upper planar surface 20 having a pair of apertures 21 and 22 formed therein and a V-shaped slot 23 extending along a side portion of the base for providing the device 10 with a gauge for use in sizing the length of wire "W" to be formed by the device into the earring wire. For a conventional Shepherd or French Hook design, the wire length generally is between one and three inches. In the illustrated embodiment of the invention, slot 23 is about 1.75 inches in length to provide an average length and one that is easy to measure and manufacture.

Figure 2:
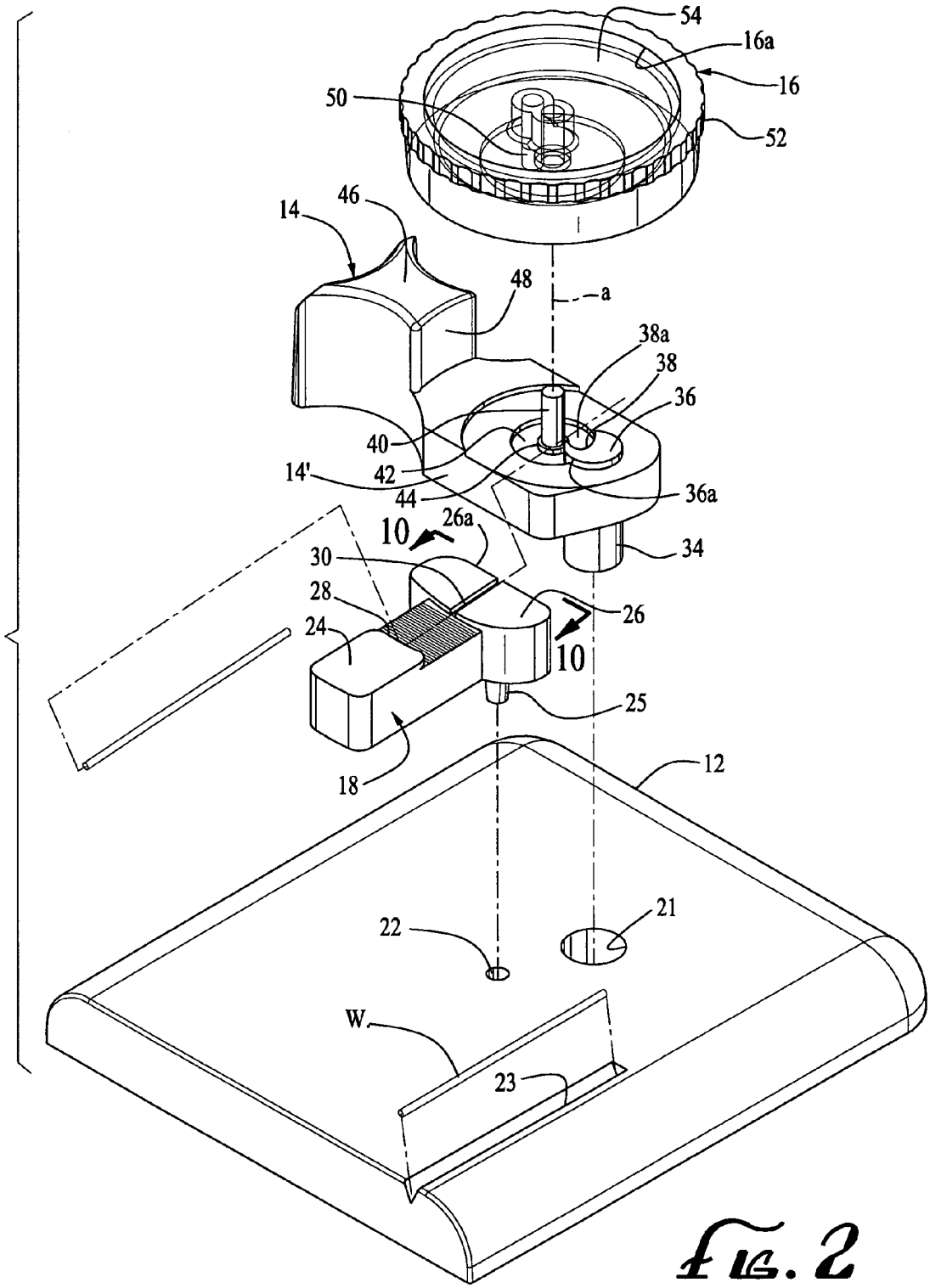
FIG. 2 is an exploded perspective view illustrating the various components of the forming device of the present invention.

Alternatively, the slot could be longer and measuring indicia provided on the base adjacent the slot for providing earring wires of varying lengths. As seen in FIG. 2 and as will be discussed later herein, apertures 21 and 22 are adapted to receive a post 34 and a pin 25 on lever 14 and kicker 18 respectively to provide pivot mountings for the lever and the kicker on the base 12.

Figure 4:
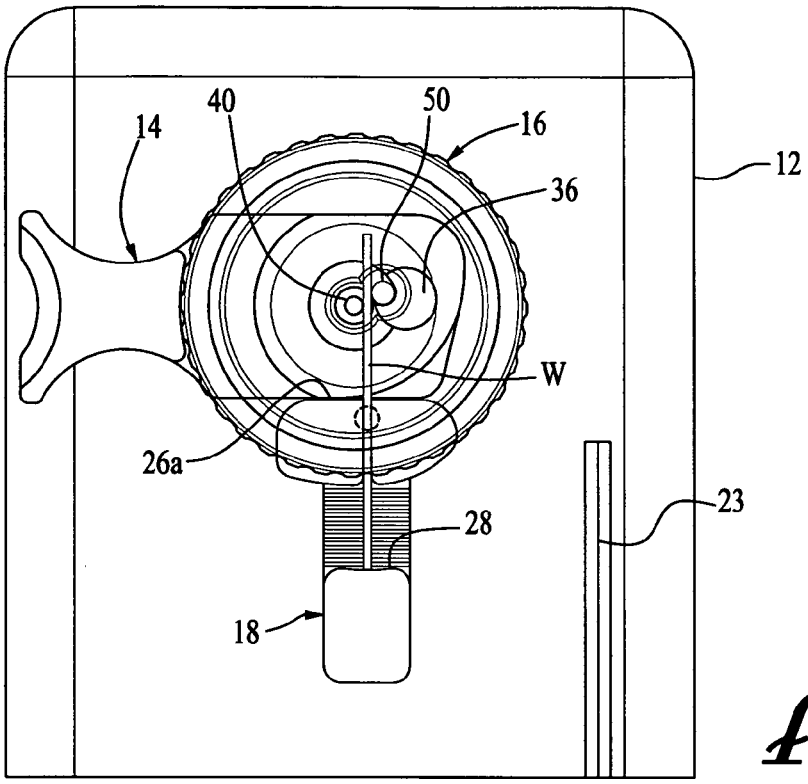
FIG. 4 is a top plan view of a portion of the earring wire forming device of the present invention with a measured length of wire positioned therein.

In its preferred configuration, the kicker 18 defines a longitudinal leg portion 24 and a forward transverse portion 26. The leg portion 24 defines a transversely extending wire abutment shoulder 28. The transverse portion 26 defines a linearly extending groove 30 in the upper surface therein coincident with the central axis of the leg portion 24 for holding the finite length of earring wire W that has been sized (e.g. 1.75 inches in length) using slot 23 (see FIG. 4), although pre-sized lengths of wire could be provided with the forming device 10. The kicker 18 is sized and configured such that when the length of wire W is inserted in groove 30 and pushed rearwardly against the shoulder 28 on the kicker, the wire will project from groove 30 the desired distance for shaping by the forming device 10 as shown in FIG. 4 and as will be described.

Figure 5:
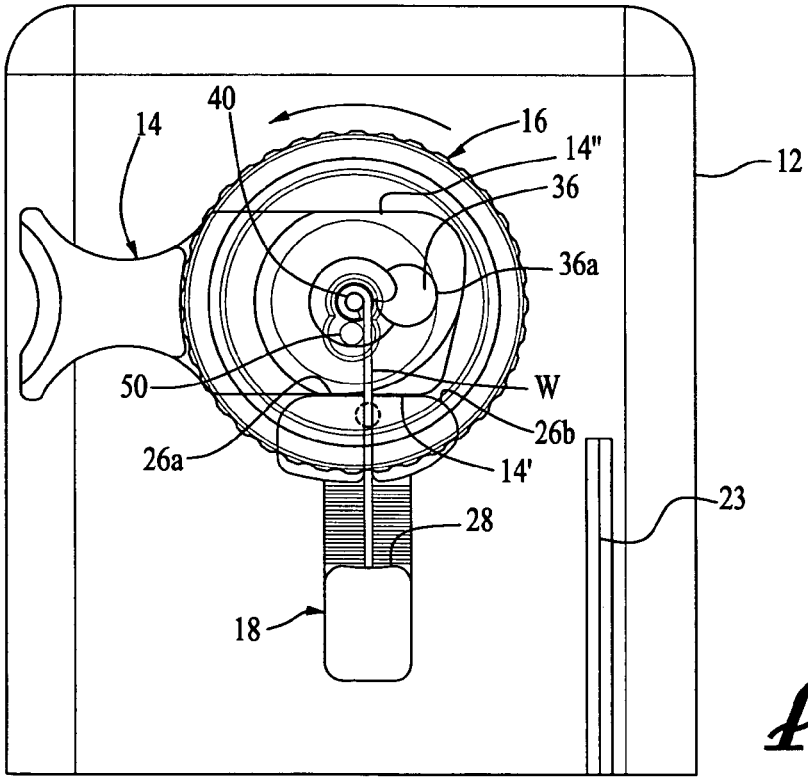
FIG. 5 is a top plan view of a portion of the earring wire forming device illustrating the forming of the small loop portion of the earring wire.
Figure 7:
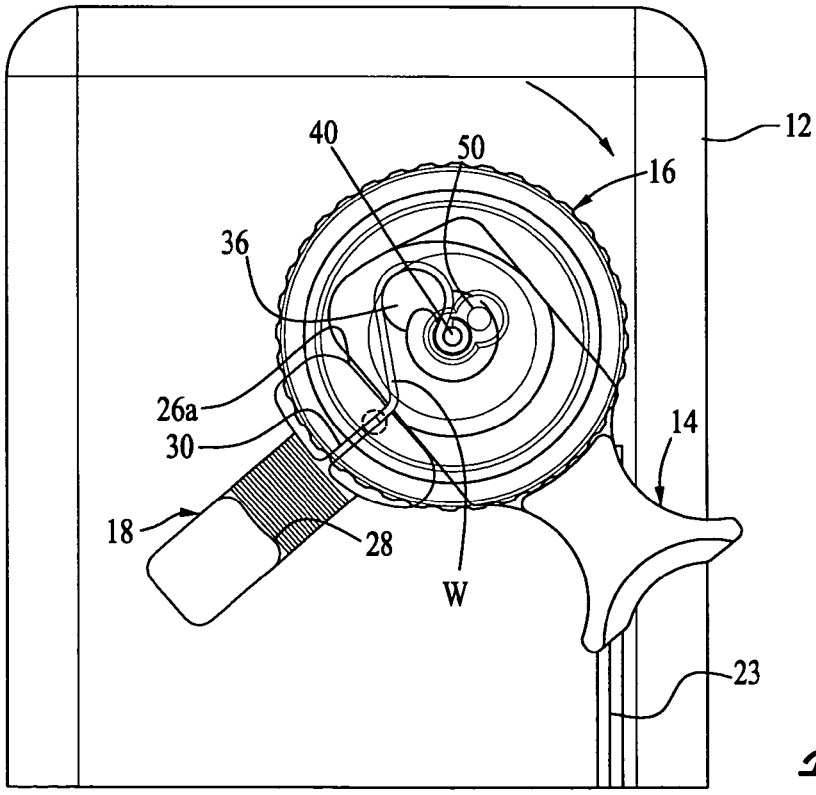
FIG. 7 is a top plan view of a portion of the earring wire forming device illustrating the final forming of the large loop portion of the earring wire, the leg portion and the outwardly inclined end portion thereof.
Figure 8:
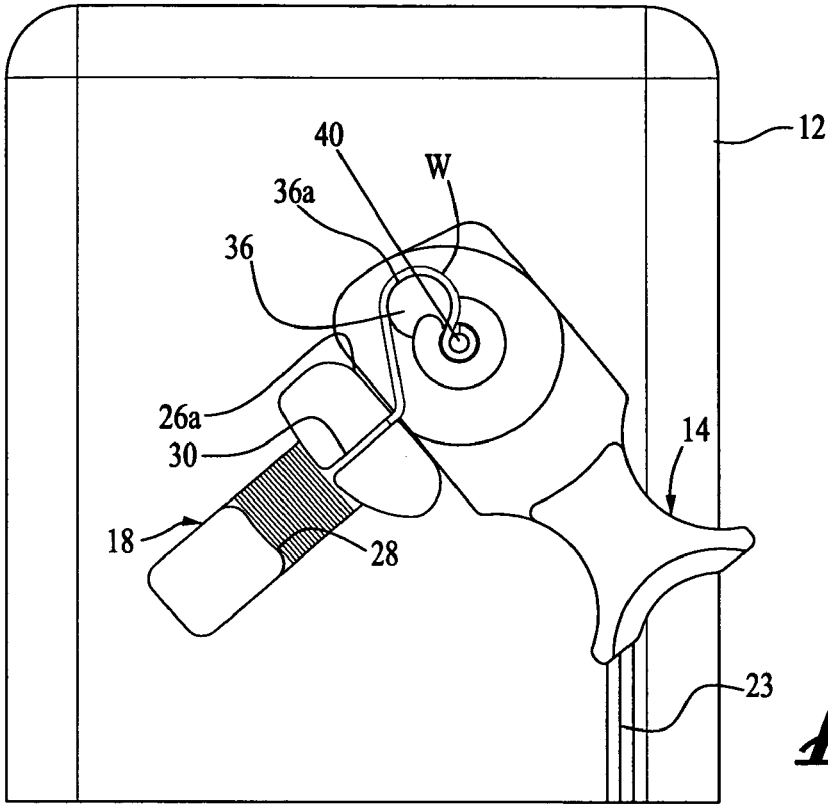
FIG. 8 is a top plan view of a portion of the earring wire forming device illustrating the final forming of the large loop portion of the earring wire and the leg portion thereof with the forming disk removed.
Figure 9:
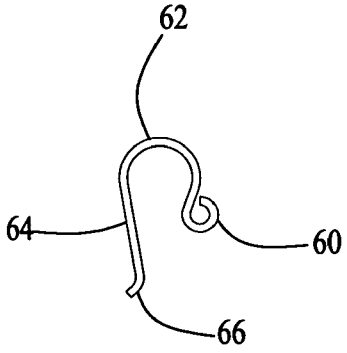
FIG. 9 is a side view of the earring wire formed with the device of the present invention.

The lever 14 is rotatably mounted on the base 12 of device 10 in a generally perpendicular disposition with respect to kicker 18 by means of cylindrical post 34 projecting downwardly from the underside of lever 14 into the aperture 21 in the base 12. Through such a mounting, the lever 14 is rotatable clockwise from a first position illustrated, for example, in FIGS. 4 and 5, to a second position illustrated in FIG. 6 and to a third position illustrated in FIGS. 7 and 8. In the first position, the longitudinal axis of the lever is perpendicular to the longitudinal axis of the kicker 18 and one side 14' of the lever abuts the end 26*a* of the transverse portion 26 of the kicker. In the second position illustrated in FIG. 6, the other side 14" of the lever abuts the kicker at 26*b*. In the third position illustrated in FIGS. 7 and 8, side 14" of the lever abuts end portion 26*a* of the kicker. It should be noted that in moving between the positions illustrated in FIGS. 6 and 7, the lever also rotates the kicker clockwise approximately 45°.

Lever 14 also includes an upstanding cylindrical projection 36 defining a crescent-shaped slot 38 therein, a center post 40 extending upwardly from the upper surface of the lever 14, an annular recessed area 42 disposed about post 40 and a shoulder 44 radially spaced from the perimeter of recessed area 42. The crescent-shaped slot 38 in projection 36 is positioned such that the open side 38*a* of the slot generally faces the center post 40 as seen in FIG. 2. While the lever is preferably molded so as to be of single-piece construction, it is to be noted that the upstanding cylindrical projection 36 within which the crescent-shaped slot 38 is formed and the depending post 34, which rotatably mounts the lever on the base 12, can be of equal diameter and thus can be formed from a single cylindrical member extending through and held within an aperture formed in the lever by a press fitment and/or other suitable fastening means, including an adhesive. Lever 14 also preferably defines an elevated outer portion 46 defining an arcuate shoulder 48 preferably having the same radius as the forming disk 16.

The forming disk 16 in the earring wire forming device 10 of the present invention is of a cylindrical configuration and is rotatably mounted on the upstanding center post 40 on lever 14. The disk 16 carries a depending wire forming pin 50. Pin 50 is radially spaced from the axis of rotation "a" of the disk 16 so as to fit within the crescent-shaped slot 38 on the lever 14 when the disk is in a first position (see FIG. 4). Without a length of wire W extending through groove 30 in kicker 18 the forming pin 50 would allow counterclockwise rotation of the forming disk 16 on and with respect to lever 14 until the pin abuts the back side 36*a* of cylindrical projection 36 (see FIGS. 2 and 5). Forming disk 16 is preferably provided with a knurled outer surface 52 to facilitate rotation thereof and, as noted earlier, preferably defines a radius substantially equal to the radial spacings of shoulder 48 on lever 14 from axis a. In the preferred embodiment, forming disk 16 is of a molded construction and includes a cylindrical top 54 held in place in a snap fitment within the outer wall portion 16*a* of the disk. As noted earlier, disk 16 is preferably transparent. This allows the user to view the bending of wire W into its desired shape during the earring wire forming process.

Figure 10:
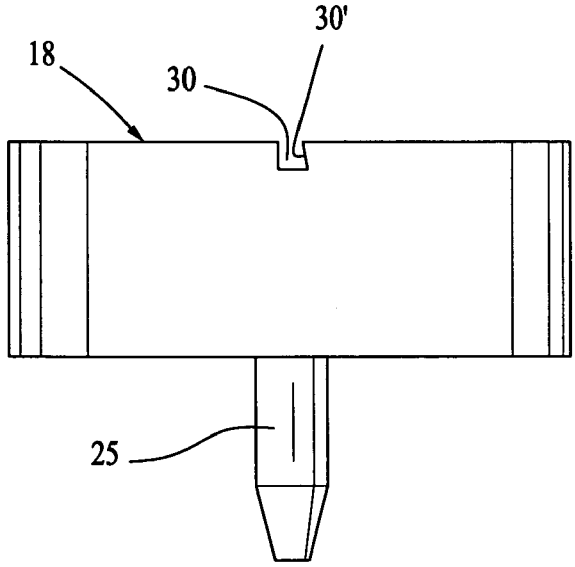
FIG. 10 is a sectional view taken along the line 10—10 in FIG. 1.

In use, the lever 14 and kicker 18 are first rotated to respective positions illustrated in FIG. 4 and the forming disk 16 is removed (lifted off center post 40). A length of earring wire is placed within gauge slot 22 and cut to the desired length. The sized length of wire W is then placed within the groove 30 in the kicker with the end of the wire abutting shoulder 28 as seen in FIG. 4. So positioned, the wire will extend from the groove 30 between the cylindrical projection 36 and center post 40 on the lever. The forming disk 16 is then positioned on the center post 40 of the lever in its initial or first position such that the forming pin 50 depending therefrom projects into the crescent-shaped slot 38 in the lever 14. Then, while holding the wire on the kicker, one rotates the forming disk 16 counterclockwise until the forming pin 50 causes the end portion of the wire W to be wrapped around the center post 40 (see FIG. 5). Such rotational movement of the forming disk not only bends the wire adjacent pin 50 but causes the end portion of the wire to be wrapped around the center post 40, forming the small bangle attachment loop portion 60 of the earring wire design. The upper surface of the kicker is provided with a plurality of transverse ridges 51 to increase the functional contact between the wire and the kicker to help hold the wire in place. In addition, the leading wall 30' forming groove 30 is preferably inclined upwardly as seen in FIG. 10 to secure the wire during the forming process.

Figure 6:
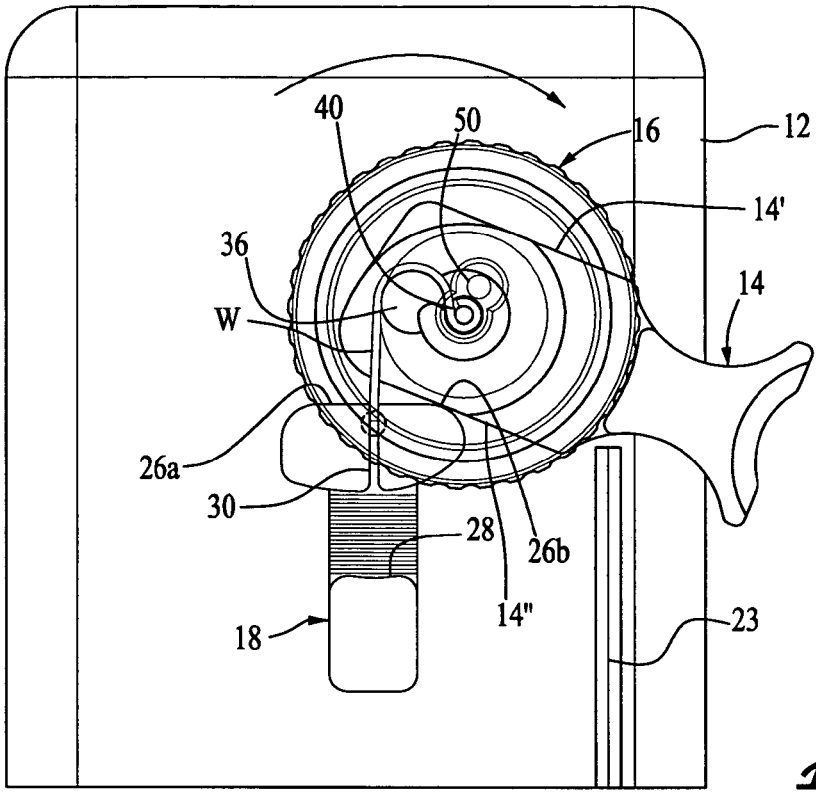
FIG. 6 is a top plan view of a portion of the earring wire forming device illustrating the initial forming of the large loop portion of the earring wire.

The lever 14 is then rotated in a clockwise direction, while concurrently applying slight downward pressure on the forming disk 16 so as to hold the kicker and wire in place on the base 12, until the lever abuts the end 26*b* of the transverse portion 26 of the kicker 18 (see FIG. 6). This initiates the formation of the large loop portion 62 of the earring wire as the wire is bent about cylindrical projection 36. Continued clockwise rotation of lever 14 while applying slight downward pressure on the forming disk will cause concurrent rotation of the kicker to the position illustrated in FIG. 7, completing the formation of the leg and end portions 64 and 66 of the earring wire. Note that the length of the sized wire W is such that upon completion of the rotation of lever 14, the end portion 66 of the wire is held within the groove 30 in the kicker, causing the desired flare of the end portion of the earring wire.

Various changes and modifications may be made in carrying out the present invention without departing from the spirit and scope thereof. By way of example, the sizes of center post 40 and cylindrical projection 36 can be varied to vary the sizes of the small and large loop portions 60 and 62 in the former earring wire. In lieu of configuring the lever 14 and kicker 18 such that they each define stops for the rotational movement of the other, separate stops could be provided on the base 12 to limit the rotational movement of the lever and kicker. The base could also provide for alternate mounting locations of the kicker and appropriately positioned stops on the base to provide longer or shorter earring wires. Further, the forming device could be configured so as to extend the sized length of wire W between the center post 40 and cylindrical projection 36 from the opposite side of lever 14. This would have the advantage of the user no longer having to hold the wire from sliding as the small loop portion is formed around post 40 and the forming device 10 also might be more intuitive for the operator to use. To provide such a mounting of wire length W, a moveable stop (not shown) would be positioned on the lever or on the base to properly position the wire relative to center post 40, cylindrical projection 36 and the groove 30 in the kicker into which the extended end portion of the wire would still project. Insofar as these and other changes and modifications of the earring forming device 10 are within the purview of the appended claims, they are to be considered as part of the present invention.

In addition to such changes and modifications, the use of the forming device 10 can also be varied to create variations in the formed earring wire. For example, if one did not utilize the disk 16, which normally is employed to form the small loop portion 60, the user could add a bead or other ornamental element directly on the earring wire, in addition to or in lieu of a bangle depending from the small loop 60. In such cases the loop 60 could be formed in a secondary forming process to hold the ornamental element in place. Longer and shorter wires could be employed. Alternatively, in lieu of a small loop, like loop 60, a spiral or other decorative shape could be formed at the end of the wire as that portion of the earring wire is not passed through the ear. The spiral or other decorative shape formed at the end of the wire may or may not have a bangle depending therefrom and may or may not support a bead or other decorative element on the portion of the wire immediately above the spiral or other decorative wire configuration.

What is claimed is:

1. An earring wire forming apparatus comprising:

a base;

a lever rotatably mounted on said base and defining a cylindrical projection thereon, said projection having a slot formed therein;

a wire holding member rotatably mounted on said base, said member limiting the rotational movement of said lever and defining a groove therein for holding a portion of a wire of predetermined finite length;

a cylindrical boss extending upwardly from said lever proximate said projection;

a forming member removably and rotatably mounted on said boss; and a wire forming pin depending from said forming member and being movable with said forming member upon the rotation of said forming member about said boss between a first position wherein said pin extends into said slot in said projection on said lever and a second position proximate the opposite side of said projection from said slot.

2. The earring wire forming apparatus of claim 1 wherein said slot in said projection is substantially crescent-shaped.

3. The earring wire forming apparatus of claim 1 wherein said wire holding member defines an elongated portion and a transverse portion, said groove extending linearly through said transverse portion for positioning a wire of predetermined finite length therein such that said wire extends along said elongated portion of said wire holding member and projects from said transverse portion thereof between said cylindrical projection and said boss on said lever.

4. The earring wire forming apparatus of claim 1 wherein said groove in said wire holding member is oriented with respect to said lever so as to position a predetermined length of wire therein such that the wire projects therefrom between said cylindrical projection and said boss on said lever.

5. The earring wire forming apparatus of claim 4 wherein said forming member comprises a cylindrical disk.

6. An earring wire forming apparatus comprising:

a base;

a wire holding member rotatably mounted on said base;

a lever rotatably mounted on said base, said wire holding member limiting the rotational movement of said lever on said base between a first position and a second position;

a first cylindrical loop forming member disposed on said lever and projecting upwardly therefrom;

a second cylindrical loop forming member disposed on said lever and projecting upwardly therefrom, said first loop forming member having a diameter larger than the diameter defined by said second loop forming member;

a forming disk removably and rotatably mounted on said lever; and a wire forming pin depending from said forming disk and being movable with said forming member between a first position adjacent a first portion of said first cylindrical loop forming member and a second position proximate a second portion of said first cylindrical loop forming member upon said forming member being rotated on said lever.

7. The earring wire forming apparatus of claim 6 wherein said first position is defined by a slot disposed in an upper end portion of said first cylindrical loop forming member.

8. The earring wire forming apparatus of claim 7 wherein said slot is substantially crescent-shaped defining an open end and a closed end and wherein said second position is spaced substantially across said first cylindrical loop forming member from said closed end of said slot.

9. The earring wire forming apparatus of claim 6 wherein said wire holding member defines a linear groove therein for positioning a wire of predetermined finite length therein such that said wire projects therefrom between said first and second cylindrical loop forming members on said lever.

10. The earring wire forming device of claim 6 wherein said lever includes a raised end portion whereby said lever can be held in place during rotation of said forming member.

11. The earring wire forming device of claim 6 wherein said wire holding member defines an elongated portion and a transverse portion, a line or groove extending through said transverse portion and an abutment shoulder on said elongated portion whereby upon positioning a wire of predetermined finite length in said groove and against said shoulder, said wire projects from said transverse portion between said first and second cylindrical loop forming member on said lever.

12. The earring wire forming device of claim 6 wherein said wire holding member is adapted to carry a wire of predetermined finite length therein such that said wire projects therefrom between said first and second cylindrical loop forming members on said lever and wherein said wire holding member defines a transverse portion for abutting said lever and limiting said rotational movement of said lever.

13. The earring wire forming apparatus of claim 9 wherein said linear groove is defined by a pair of upstanding wall portions, one of said wall portions being inclined upwardly and inwardly for facilitation the retention of a portion of said wire therein during the forming of the earring wire.

14. The earring wire forming device of claim 12 wherein said transverse portion additionally defines a linear groove therein for positioning a wire of predetermined finite length therein such that said wire projects therefrom between said first and second cylindrical loop forming members on said lever.

15. An earring wire forming apparatus comprising:

a base;

a lever moveably mounted on said base and defining a cylindrical projection thereon, said projection having a slot formed therein;

a wire holding member moveably mounted on said base and defining a groove therein for receiving and holding a portion of a wire of predetermined finite length;

a stop mounted on said base for limiting the movement of said lever thereon;

a cylindrical boss extending upwardly from said lever proximate said projection;

a forming member removably and rotatably mounted on said boss; and a wire forming pin depending from said forming member and being moveable with said forming member upon the rotation of said forming member about said boss between a first position wherein said pin extends into said slot in said projection on said lever and a second position proximate the opposite side of said projection from said slot.

16. The earring wire forming apparatus of claim 15 wherein said stop is defined by a portion of said wire holding member.

17. The earring wire forming apparatus of claim 15 wherein said slot in said projection is substantially crescent-shaped.

18. A method for forming an earring wire comprising:

positioning a predetermined length of wire in a slot bordered by retaining walls such that a portion of said wire extends a predetermined distance from said slot between a pair of substantially laterally spaced cylindrical posts wherein the diameter of one of said posts is larger than the diameter of the other of said posts;

moving said portion of said wire in a first circular direction about the smaller of said posts while maintaining said retaining walls in a stationary disposition;

moving a second portion of said wire along a curvilinear path in a second direction opposite to said first direction about said second post while maintaining said retaining walls in a stationary disposition; and continuing to move the second portion of said wire along a curvilinear path in the second direction about said second post while allowing rotational movement of said retaining walls.

* * * * *